United States Patent [19]

McKellar

[11] Patent Number: 4,651,921

[45] Date of Patent: Mar. 24, 1987

[54] POSTAL SERVICE FACILITY

[76] Inventor: Mark B. McKellar, 3130 Walnut Bend, #404, Houston, Tex. 77042

[21] Appl. No.: 750,404

[22] Filed: Jun. 28, 1985

[51] Int. Cl.[4] ..... B65D 91/00

[52] U.S. Cl. ..... 232/25; 232/43.4

[58] Field of Search ..... 232/4 R, 6, 24, 25, 232/43.4; 109/56; 312/211, 212

[56] References Cited

U.S. PATENT DOCUMENTS

| | | | |
|---|---|---|---|
| 618,846 | 2/1899 | Crowder | 232/25 |
| 693,770 | 2/1902 | Wright et al. | 232/17 |
| 1,362,949 | 12/1920 | Lillard | 232/25 |
| 1,605,118 | 11/1926 | Kolstad | 232/24 |
| 4,161,274 | 7/1979 | Bishop et al. | 232/25 X |
| 4,164,907 | 8/1979 | Piatscheck et al. | 109/56 X |
| 4,509,676 | 4/1985 | Stacy | 232/43.4 |

*Primary Examiner*—Robert P. Swiatek

*Attorney, Agent, or Firm*—William E. Shull; Paul F. Simpson

[57] ABSTRACT

A postal service facility including a housing, access areas for supporting postal service equipment installed on or within the housing surface, and a rotatable assemblage of postal boxes disposed between mounts within the accessible housing interior. A lockable outer door provides access to the assemblage in the housing interior. Electric switches controlling a motor and a brake provide the preferred means of rotating the assemblage. The assemblage contains a plurality of individually lockable postal boxes. Locking strips or lockable panels allow concurrent access to a plurality of boxes to facilitate delivery of posted items to the boxes. The assemblage can be generally cylindrical in shape for most efficient use of space. Alternatively, the assemblage can be rectangular in cross section.

17 Claims, 13 Drawing Figures

POSTAL SERVICE FACILITY

BACKGROUND OF THE INVENTION

The present invention relates to a general-purpose postal facility more satisfactorily meeting the needs of users than previously available equipment. The subject matter of the invention is also discussed generally in my copending design patent applications entitled "Self-Service Postal Facility," Ser. No. 726,043, and "Postal Box Assemblage," Ser. No. 726,026, both filed Apr. 23, 1985.

Heretofore, postal box patrons in general have enjoyed only limited access to such boxes, with the boxes installed at only a few locations, such as U.S. Post Offices or other specially designated places. These postal boxes, moreover, are typically arranged in a space-consuming manner in horizontal arrays along walls or the like. In most cases, the need to open and access these fixed boxes from two sides, for easy delivery from one side and later receipt of items from the other, requires dedication of a substantial area for even relatively small postal box assemblies. In some cases, access from two sides is not required, and both delivery and receipt are accomplished from the front of the boxes. Even in those situations, however, a substantial area is required for the postal box arrays simply due to the required physical dimensions of the arrays.

In addition, proliferation of private parcel services of late reflects the demand of mail users for rapid, alternative means of shipping items. While there exists a multiplicity of ways to deliver packages to such services, one means involves a facility for receiving and storing posted items for subsequent retrieval and shipping. Such a facility may be placed near an official U.S. postal box location, for the benefit of patrons, Again, though, such locations are limited in number, and the private parcel facility requires space otherwise available to the postal box array.

SUMMARY OF THE INVENTION

According to the invention, the postal service facility includes a single facility housing providing means for a parton's performing of several tasks within a comparatively small space. The housing includes areas where patrons can use postal service equipment -- postage meters, scales, stamp dispensing machines, and the like -- installed on or within the surfaces of the housing. It is envisioned that means for direct payment of charges for postal and parcel services can be provided, such as electronic or other means for credit or debit transactions to pay for services utilized. The housing can further provide locations for deposit and storage of letters, packages, and similar items for later shipping by mail or private parcel services.

The housing also encloses an assemblage of postal boxes and allows access to the assemblage from the exterior. In the preferred embodiment, this assemblage rotates between mounts attached to the interior of the housing. The assemblage contains postal boxes disposed radially about its center, and the assemblage can rotate for accessing a selected box. The area necessary to utilize the postal boxes, then, is only the area required to open an access door of the housing to reach the assemblage on the interior. A user can cause rotation of the assemblage to expose the desired individual postal box.

Each box has a door and an individual lock as do conventional postal boxes.

To facilitate ready access of multiple boxes for delivery of items, the assemblage can be equipped with a multiple access door or other means to open several boxes at once. The preferred embodiment has locking strips attached to the opening edge of the doors of vertically aligned individual boxes. Each strip can be locked at its opposite ends to an adjacent portion of the body of the assemblage. When unlocked, a strip provides means to open simultaneously all the doors attached to it. Another embodiment providing multiple access to boxes includes door portions of the exterior shell of the assemblage body which are hinged to open and are individually lockably securable. Individual box doors mounted on this multiple access door provide individual access when the multiple door is closed and locked.

The housing, assemblage, and other elements of the invention can be fabricated of any suitable materials (e.g., plastics, aluminum, steel, etc.) for the purposes of the invention. Moreover, the postal box assemblage can assume any of a number of shapes, depending on costs, individual preferences, needs of users, or other considerations. The embodiments shown include a substantially cylindrical assemblage, and one with a generally rectangular cross section. A cylindrical assemblage affords the maximum number of equally-sized individual storage boxes for a given area of rotation. The rectangular assemblage provides fewer boxes than a comparable cylindrical rotating assembly, but the boxes are more easily made constant in cross section, if so desired.

The principles of the invention will be further discussed with reference to the drawings wherein a preferred embodiment and alternative embodiments are shown. The specifics illustrated in the drawings are intended to exemplify, rather than limit, aspects of the invention as defined in the claims.

DESCRIPTION OF THE PREFERRED EMBODIMENT

Although the present invention can take the form of a variety of embodiments, FIG. 1 through FIG. 11 depict details of one of the preferred embodiments of the invention.

Figure 1:
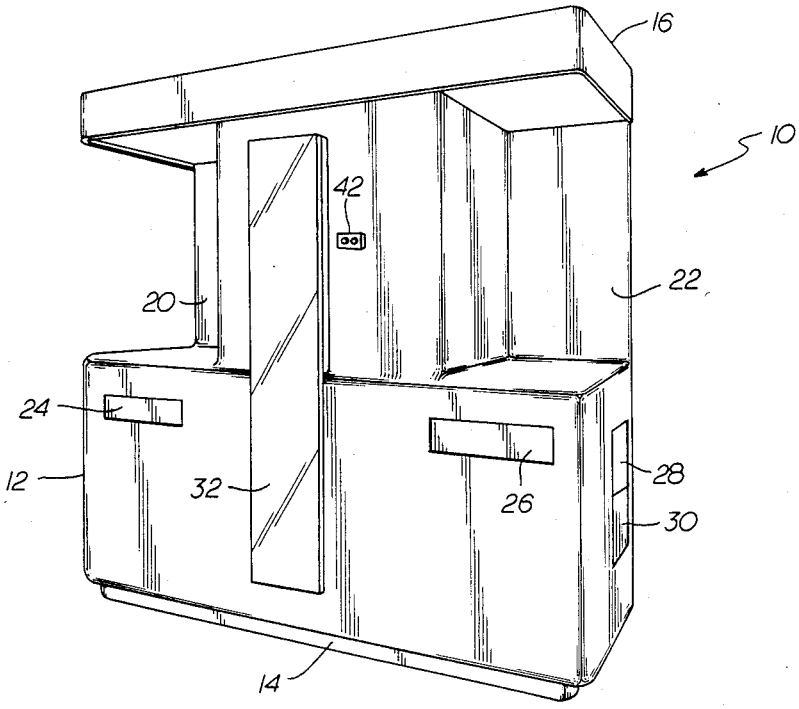
FIG. 1 is an upper perspective view of a self-contained postal facility in accordance with the invention, showing part of the exterior of the facility.

In FIG. 1, the postal service facility of the invention, indicated generally at 10, includes a housing 12 supported by a base 14 with a canopy 16 overhead. Patrons can utilize postal service equipment (not shown), for example, postage meters, scales, or stamp dispensing machinery, installed on or in the surfaces of the housing 12 at or near access areas 20, 22. Mail deposit slots 24, 26 are available for utilizing U.S. mail or private parcel services. Users can deposit packages through parcel slot 28 for subsequent pick-up by a delivery service through a parcel retrieval door 30 from storage areas (not shown) within the housing 12.

Figure 2:
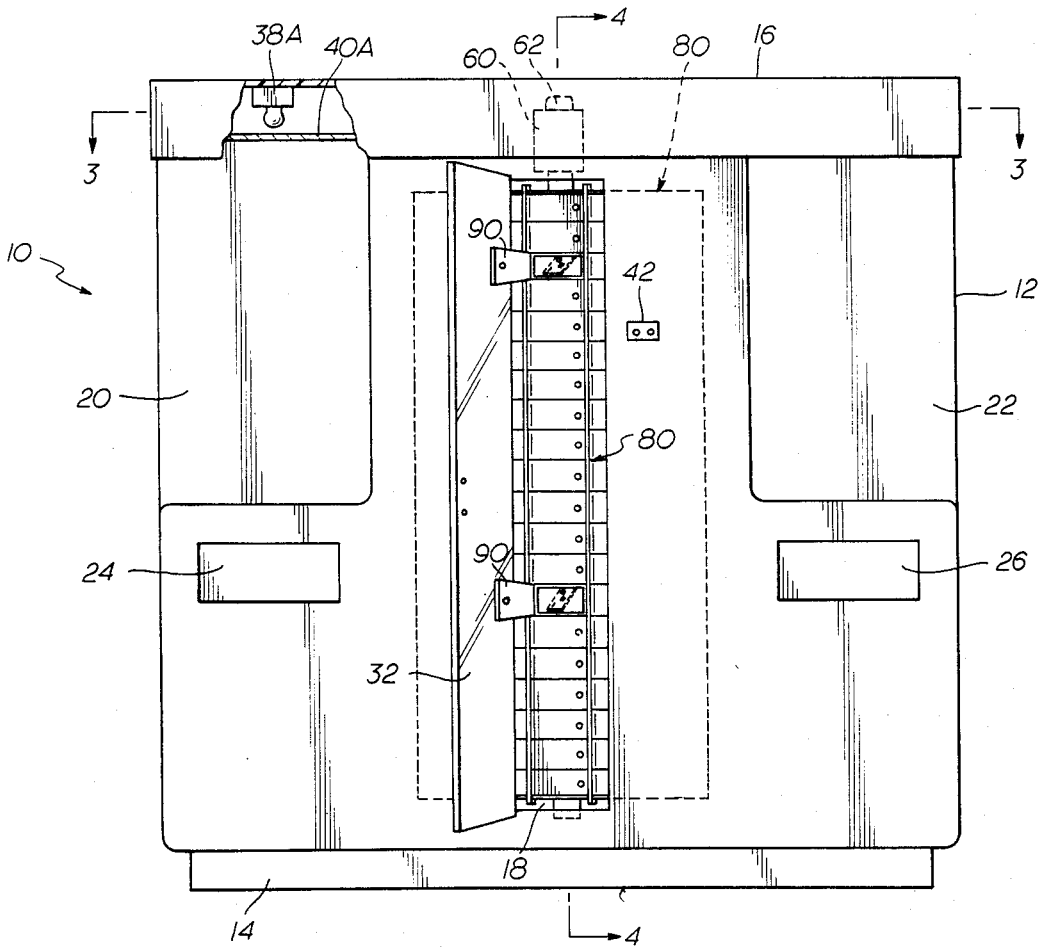
FIG. 2 is a side elevational view of the postal facility in FIG. 1, depicting the interior access door in the open position to show the postal box assemblage inside the housing, two individual postal box doors in the open position, a portion of the upper canopy cut away to show interior overhead lighting therein, and dotted lines showing the interior presence of the postal box assemblage and a motor and brake for rotating and stopping the assemblage.

FIG. 2 shows part of the canopy 16 cut away to expose an overhead light fixture 38A with an overhead light shield 40A. The housing access door 32 is shown in the open position, exposing the housing interior 18 wherein resides the postal box assemblage, indicated generally at 80. Housing access door 32 may be equipped with a lock (not shown) allowing only authorized users to have access to the housing interior 18. Each authorized user's individual key could be able to unlock the housing access door 32 lock or, alternatively, each authorized user might be provided with a separate key for the housing access door 32 lock. The housing access door 32 may be provided with a handle, or alternative means can be provided, such as a finger groove, for enabling patrons to grasp the door for opening it. Such a finger groove might well be provided to enhance the overall appearance of the postal service facility of the invention. A patron can cause rotation of the postal box assemblage 80, by means of the assemblage rotation and brake switches 42 on the exterior of the housing. The two switches 42 respectively actuate the motor 60 or the brake 62 to rotate and to stop the assemblage 80. It should be appreciated that switches 42 may be positioned so as to be partially or completely hidden from ready view, so as to improve the aesthetics of the invention and to minimize unauthorized tampering with the switches.

Figure 3:
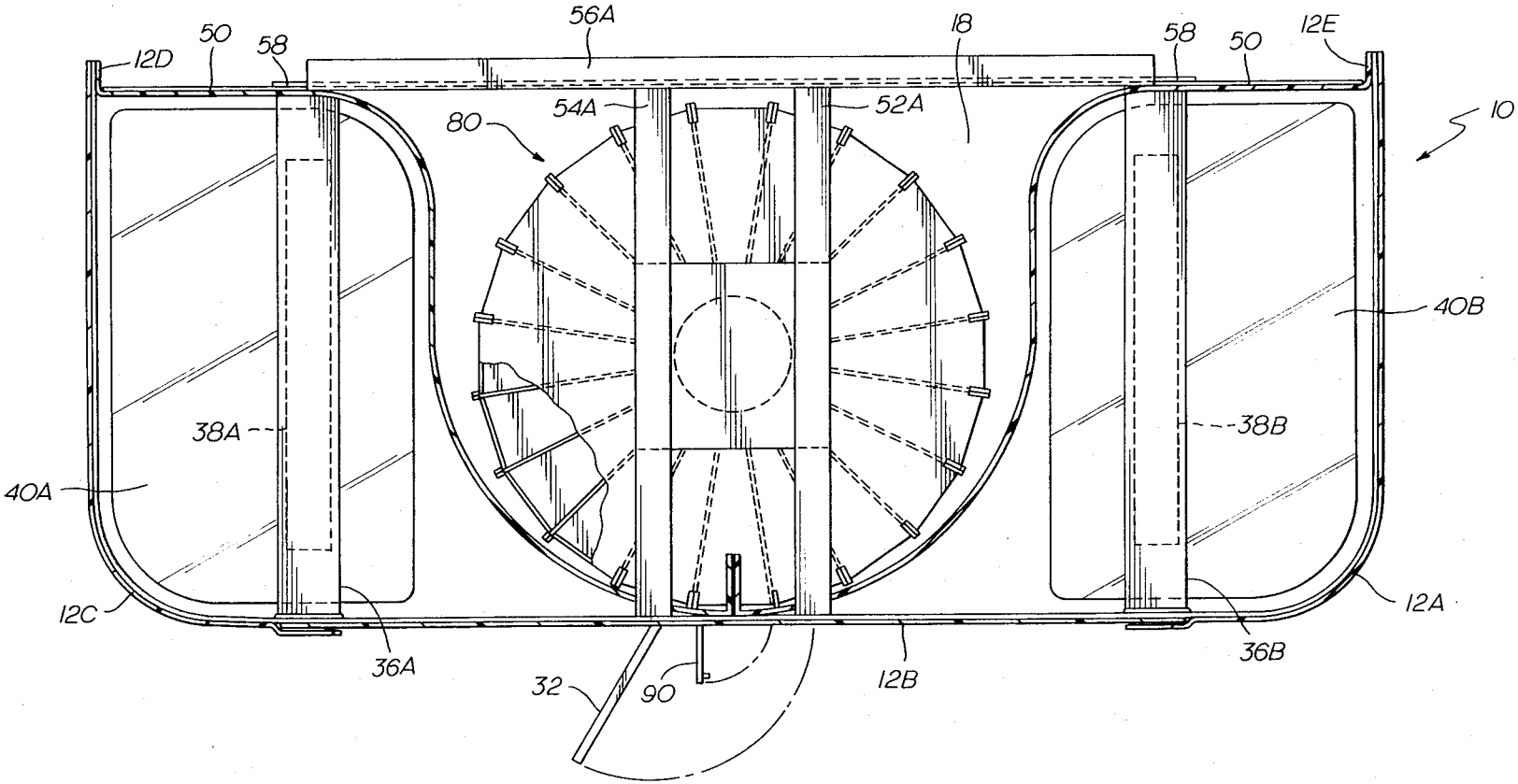
FIG. 3 is a plan sectional view through the canopy of the postal facility of FIG. 2.

It can be seen from FIG. 3 that the housing 12 is actually composed of five separate housing elements snapped, cemented, bolted, or riveted together, or otherwise combined to form one integral unit. Left front housing element 12A and right front housing element 12C, together with front central housing element 12B, form the forward exterior of the housing 12. Right rear housing element 12D and left rear housing element 12E combine as shown to complete the rear of the housing 12. The housing elements are designed to be symmetrical so that housing elements 12A and 12C can be nested and housing elements 12D and 12E can be nested, for ease in packing and shipment. A T-shaped upper mounting bracket fashioned from two cross members 52A, 54A and a single back member 56A supports the upper end of postal box assemblage 80. A horizontal brace 58 helps to support the lower mounting bracket (FIG. 4), which supports the lower end of postal box assemblage 80. The lower mounting bracket (FIG. 4) similarly has two cross members 52B, 54B (54B not shown) and one back member 56B. A back panel 50 encloses the housing interior 18. The overhead lights 38A, 38B supported by the light fixture brackets 36A and 36B provide lighting for the access areas 20, 22.

Figure 4:
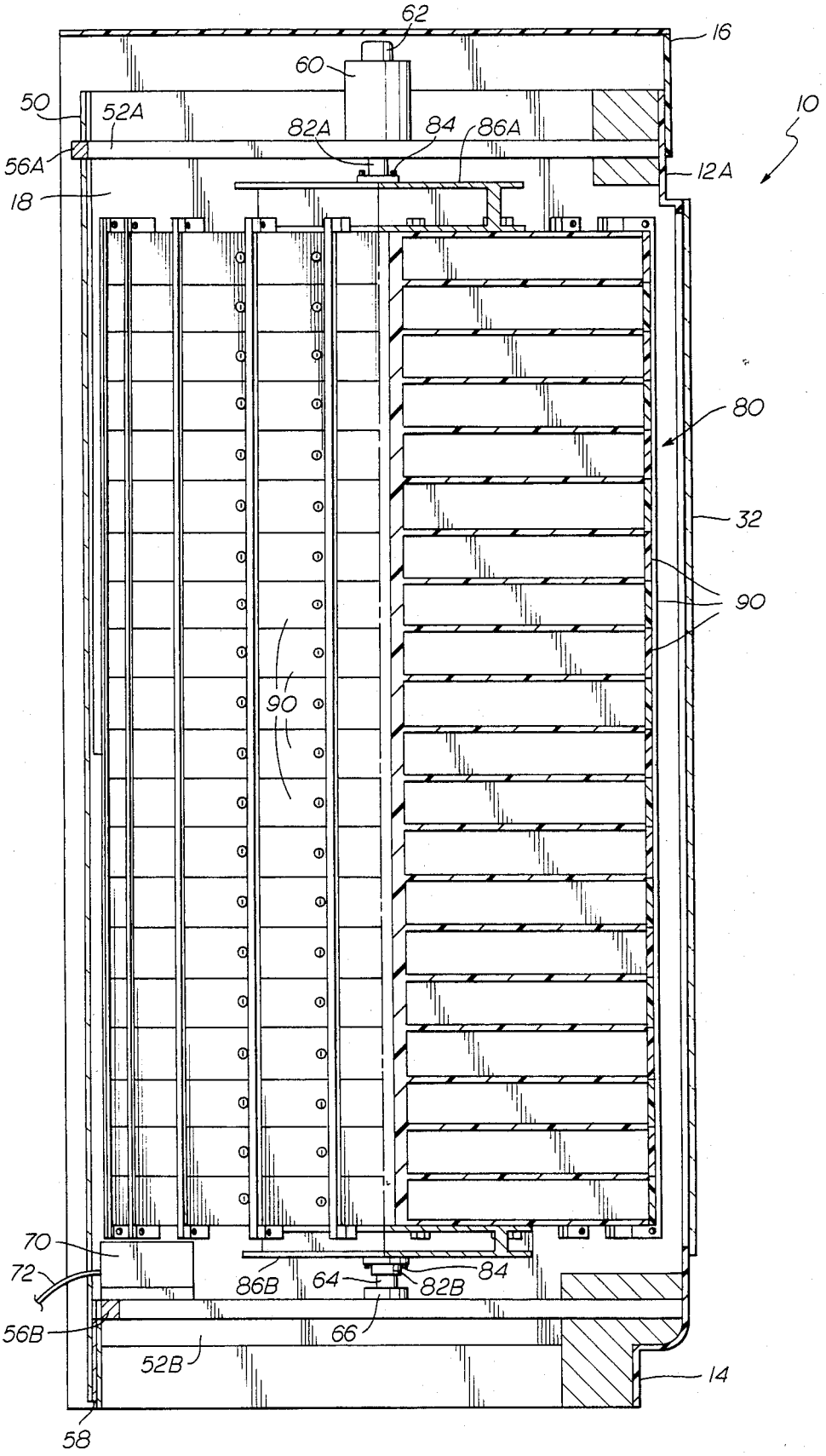
FIG. 4 is a side elevational sectional view through the axis of the postal box assemblage and the center of the postal facility of FIG. 2.

With reference to FIG. 4, the motor 60 acts to rotate the assemblage 80 by means of a shaft (not shown) turning the upper shaft adapter 82A attached with bolts 84 to the upper drum mounting plate 86A. The assemblage 80 can then rotate on the lower shaft 64 installed concentrically within the flange bearing 66 mounted on the cross members 52B, 54B (54B not shown) of the lower mounting bracket. The lower shaft 64 sits inside the lower shaft adapter 82B which is attached to the lower drum mounting plate 86B with bolts 84. An electrical junction box 70, receiving electricity from an external source by means of a wire 72, provides the necessary power for the motor 60.

Figure 6:
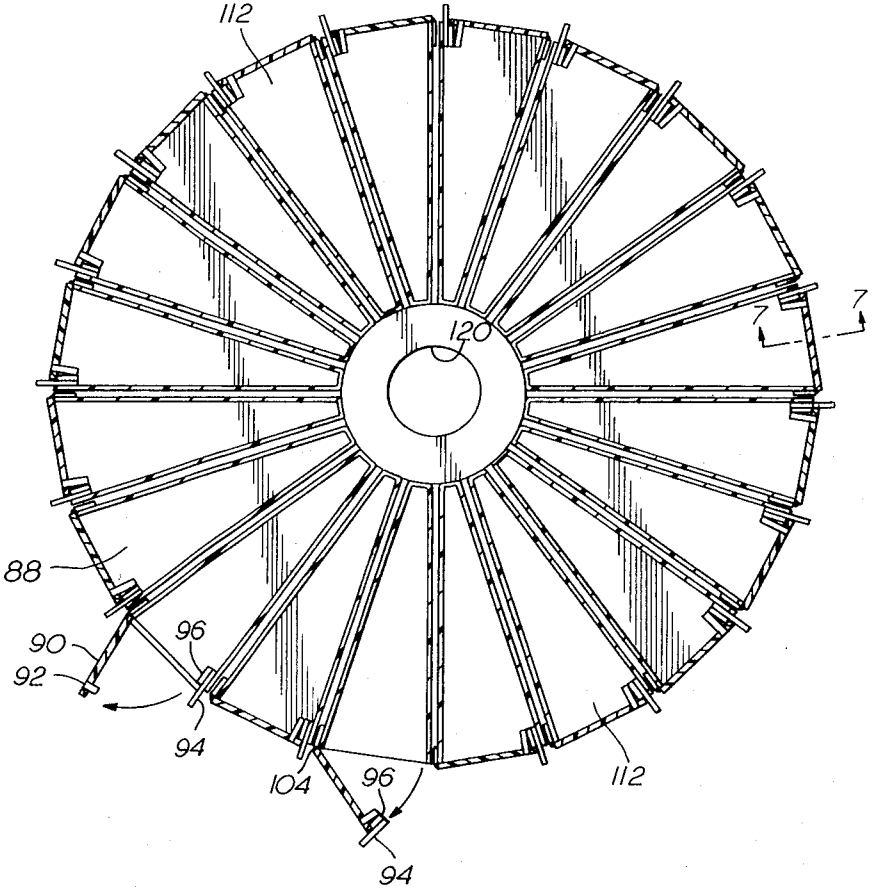
FIG. 6 is a top plan sectional view through the body of the assemblage of FIG. 5.
Figure 5:
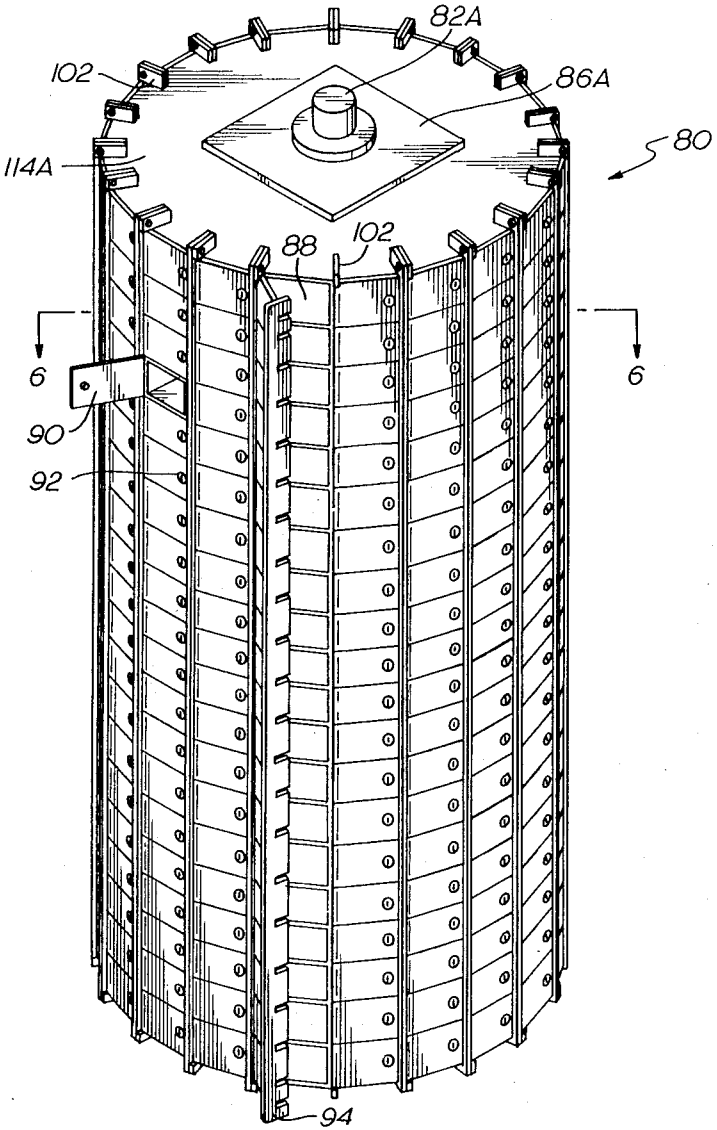
FIG. 5 is an upper perspective view of a postal box assemblage in accordance with the invention, depicting one individual postal box door open, one open multiple access locking strip attached to a row of individual box doors, and a central shaft assembly to facilitate rotation of the assemblage.
Figure 8:
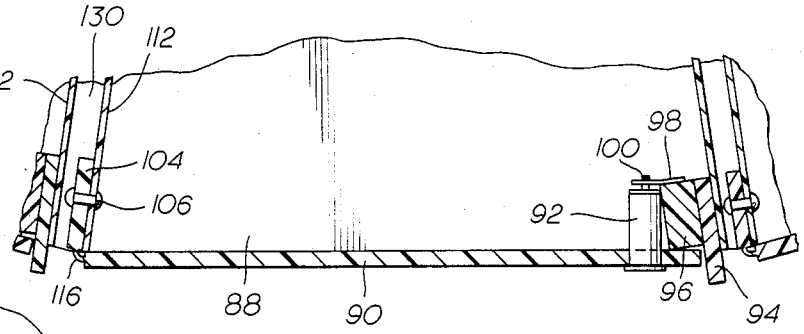
FIG. 8 is a top plan sectional view through an individual postal box of FIG. 7.
Figure 9:
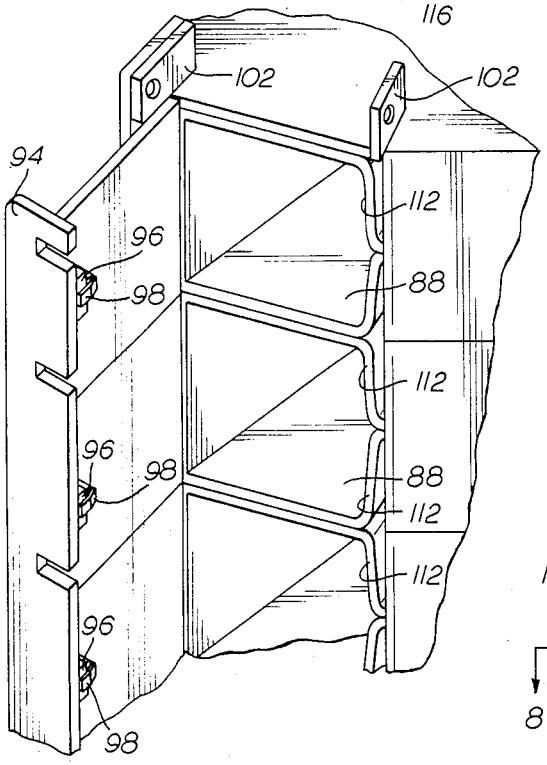
FIG. 9 is an upper fragmentary perspective view of the open locking strip and individual postal boxes and doors in the assemblage of FIG. 5.
Figure 7:
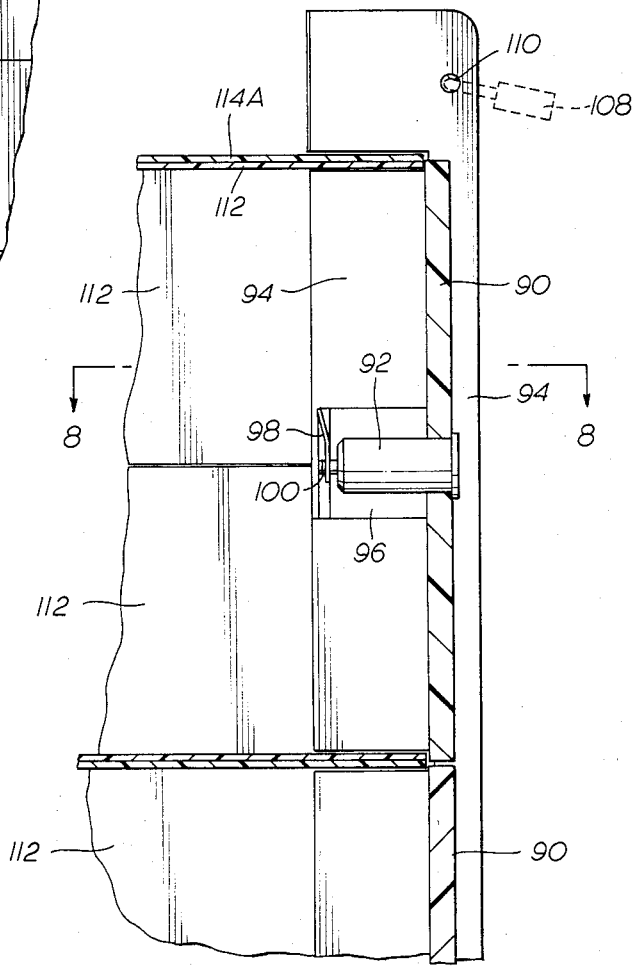
FIG. 7 is a side elevational sectional view through the locked individual box doors of FIG. 6, showing one entire individual door and a locking strip secured by a (dashed-line) lock.

Referring now to FIG. 5 and FIG. 6, the postal box assemblage 80 is shown alone. FIG. 5 shows the upper drum mounting plate 86A attached to the assemblage top 114A. The construction of the postal box assemblage 80 from formed frames 112 results in a central core space 120 radially surrounded by individual postal boxes 88. Each individual postal box 88 can be closed with a box door 90 and secured by a box lock 92. The free end of every box door 90 attaches to a locking strip 94 which is similarly joined to every other box door 90 in a column. Also with reference to FIG. 8, a box lock 92 holds a box door 90 shut when the lock stem 100 rotates the lock anchor 98 into the engaged and locked position with the catch 96 on the locking strip 94. Each box door 90 has hinge bases 104 disposed in the interior space 130 between the frames 112 forming the walls of adjacent postal boxes 88. Rivets 106 secure the hinge bases 104 to the frames 112. When the box lock 92 is unlocked, a user can swing a box door 90 open about the axis of its hinge 116 attached to the hinge base 104. FIG. 7 shows a locked box door 90, along with a locking strip 94 held to a strip anchor 102 affixed to the top and bottom of the postal box assemblage by a strip lock 108 through a lock hole 110. There are, of course, preferably two strip anchors 102 for each locking strip 94, one anchor on the top and one on the bottom of the postal box assemblage 80. When it is desired to open all of the boxes in a column, locks 108 of the top and the bottom of the postal box assemblage 80 are removed, and the locking strip 94 is pulled initially radially away from the center of the postal box assemblage 80. Each of the attached individual box doors 90 is retained, by friction, on the locking strip 94 as the locking strip 94 is pulled radially outward. The catches 96 for each of the individual box locks 92, which catches 96 are all affixed to the locking strip 94, are retained by friction between the lock anchors 98 and the inside surfaces of the individual box doors 90. As the individual doors 90 begin to swing open, the locking strip 94, with attached individual doors 90, begins to swing in an arc centered about the hinges 116 of the individual box doors 90. To close the box doors 90 after loading the mail, the locking strip 94 is swung in that same arc until the individual doors 90 are shut, and locks 108 are replaced.

Figure 10:
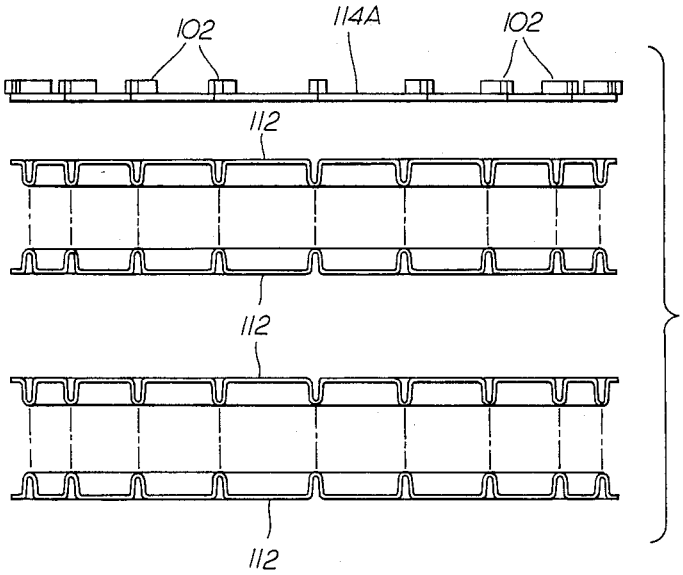
FIG. 10 is an exploded fragmentary side elevational view of the assemblage of FIG. 5, absent the doors and locking strips, illustrating the members that form the interior frame and top of the assemblage.
Figure 11:
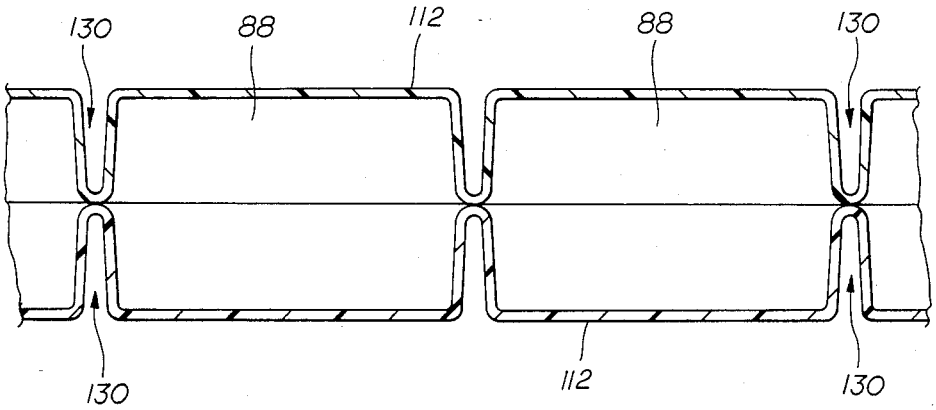
FIG. 11 is a side elevational sectional view through a portion of the interior of the assemblage of FIG. 5, showing the assembly of some of the frame members of FIG. 10.

FIG. 10 and FIG. 11 show additional construction details. Each postal box 88 results from the assembly of the molded frames 112 that comprise the skeleton of the postal box assemblage 80. While these frames 112 are molded from plastic in the preferred embodiment, a variety of materials would be appropriate for this construction. FIG. 10 also shows how the assemblage top 114A is placed in relation to the frames 112. In FIG. 11, the frames 112 are shown in assembled form, illustrating the resultant postal boxes 88 as well as the interior spaces 130 where the hinge bases 104 are disposed for attachment to the frames 112.

ALTERNATIVE EMBODIMENTS OF FIG. 12 AND FIG. 13

Figure 13:
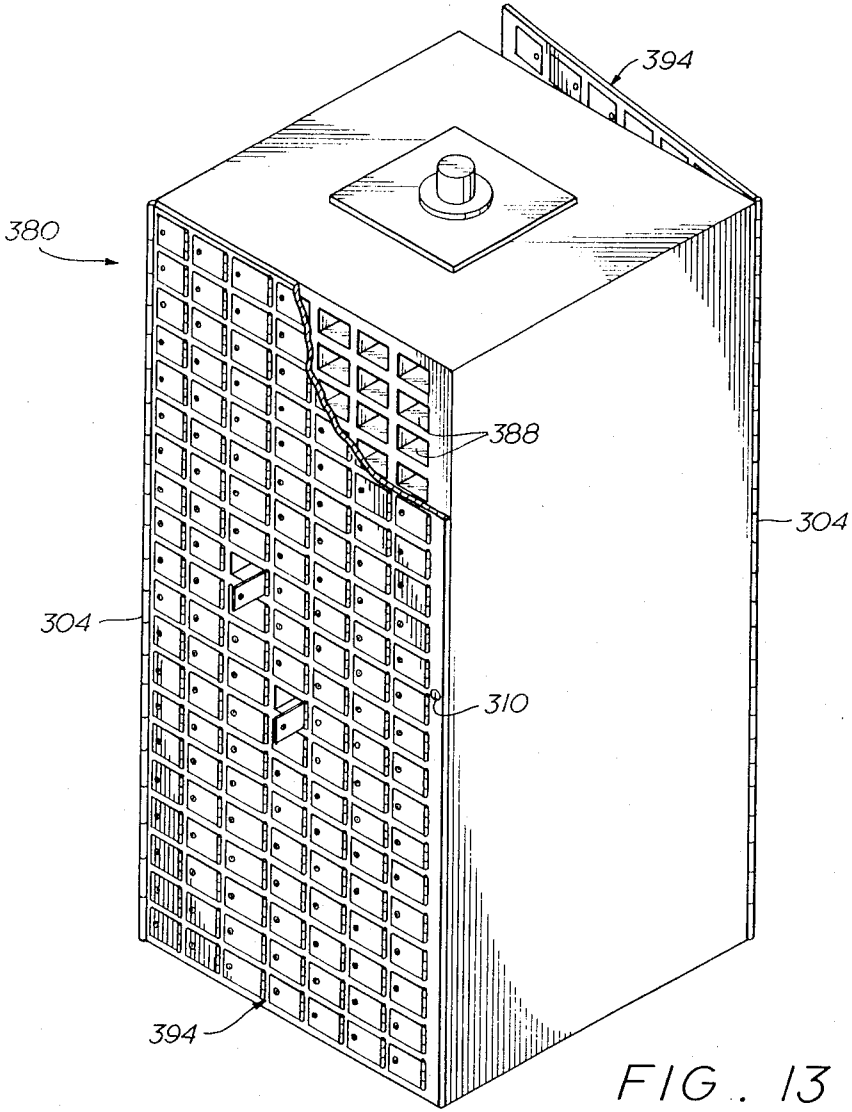
FIG. 13 is an upper perspective view of an alternative embodiment of the postal box assemblage, similar to the assemblage of FIG. 12 but generally rectangular in cross section instead of having a cylindrical shape.
Figure 12:
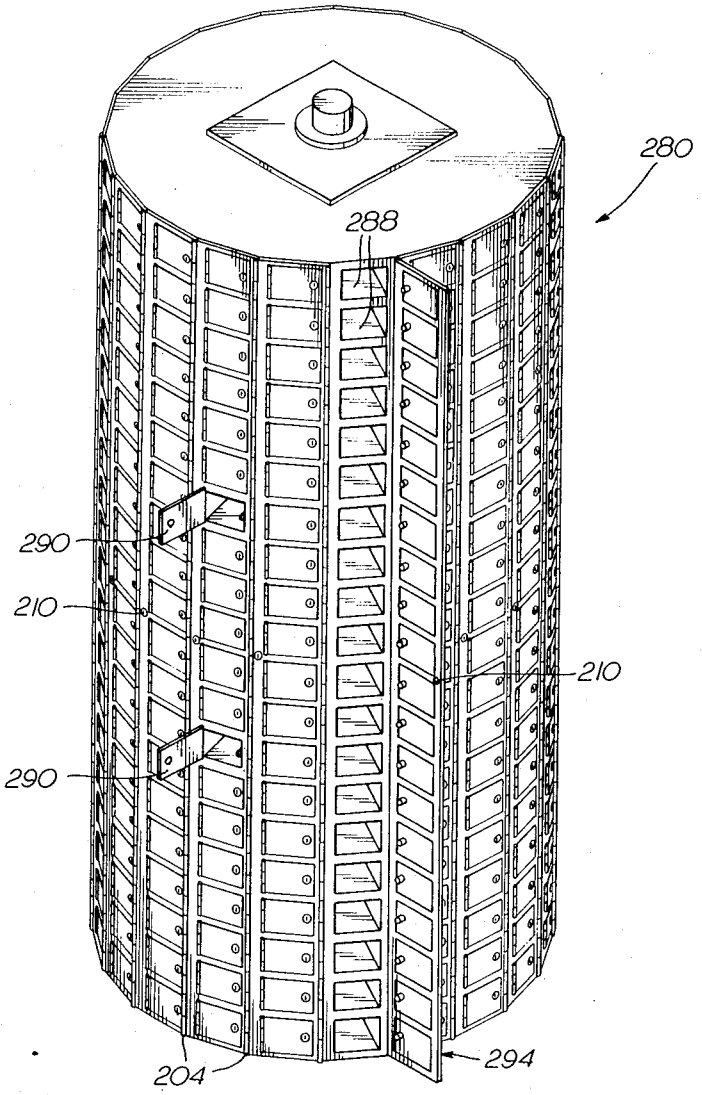
FIG. 12 is an upper perspective view of an alternative embodiment of the postal box assemblage, similar to the assemblage of FIG. 5 but utilizing multiple access doors instead of locking strips.

FIG. 12 and FIG. 13 show alternative embodiments of the invention. Details of these embodiments are largely similar to the preferred embodiment discussed above, with some variations as set out beolw.

In FIG. 12, a multiple access door panel 294 provides concurrent access to a plurality of postal boxes 288. Each door panel 294 includes a portion of the exterior skin of the postal box assemblage, indicated generally at 280, with individual box doors 290 mounted on and embodying a portion of the exterior of the door panel 294. An authorized user can release the panel lock 210 in order to rotate the door panel 294 about the axis of the door panel hinge 204 to an open position.

FIG. 13 shows the postal box assemblage, indicated generally at 380, possessing a door panel 394 similar to that of FIG. 12, each door panel 394 being attached to a door panel hinge 304 and secured by a panel lock 310. The postal box assemblage 380 is substantially rectangular in cross section with two door panels 394 on opposite sides. The configuration in this embodiment provides each postal box 388 with a constant cross section, perhaps accommodating a variety of items more easily than the shape of the postal boxes 88 and 288 in the previous embodiments. The rectangular assemblage 380, however, results in fewer total postal boxes for a given area of rotation, due to the necessity of using additional space for rotating a non-cylindrical shape.

Many varying and different embodiments are possible within the scope of the inventive concept shown and described herein, without, departing from the subject matter of the present invention. It should be understood that the invention is not restricted to the illustrated and described embodiments, and can be modified within the scope of the following claims.

I claim:

1. Apparatus for facilitating postal service, such postal service including use of equipment such as meters, scales, and stamp dispensing equipment, comprising a housing including an access area for supporting suchpostal service equipment adapted to be disposed thereon;

a canopy disposed above said housing, said canopy located at least partially over said access area;

deposit means on the surface of said housing for depositing items for shipment;

storage means within said housing for receiving and storing such items;

housing door means for accessing the interior of said housing;

mounting means within said interior, including a plurality of coaxial opposing mounts secured to said housing;

a member disposed between said coaxial opposing mounts;

an assemblage of postal boxes disposed on said member between said coaxial opposing mounts, said assemblage including a body with rotation means allowing rotation of said body about an axis therethrough;

a plurality of individual storage means for receiving and storing mail or the like within said body;

a plurality of individual hinged door means, each said individual hinged door means hingedly closing one of said plurality of individual storage means;

individual locking means on each one of said plurality of individual hinged door means for releasably locking said individual hinged door means;

multiple access means for allowing concurrent access to a first plurality of said individual storage means, said first plurality constituting less than the entirety of said plurality of individual storage means, said multiple access means being disposed substantially entirely about the exterior of said body; and multiple locking means for releasably securing said multiple access to said body, enabling such concurrent access to said first plurality of individual storage means to be effected simultaneously upon release of said multiple locking means and motion of said multiple access means.

2. The apparatus according to claim 1, wherein each said individual hinged door means and said multiple access means are both releasable through said housing door means, alternately enabling individual access to one of said individual storage means and concurrent access to said first plurality of individual storage means through said housing door means.

3. The apparatus according to claim 2, wherein said body is generally cylindrical in shape.

4. The apparatus according to claim 3, wherein said plurality of individual storage means are disposed circumferentially about said body, and said individual storage means has a depth, measure radially from said axis, substantially greater than other internal dimensions of said individual storage means.

5. The apparatus according to claim 4, wherein said multiple access means includes a strip releasably attached to an unhinged side of each said individual hinged door means closing each of said first plurality of individual storage means.

6. The apparatus according to claim 5, wherein said concurrent access to each of said first plurality of individual storage means is effected simultaneously upon motion of said strip means outwardly from said body.

7. The apparatus according to claim 2, wherein said body is substantially rectangular in cross-section.

8. The apparatus according to claim 1, wherein said housing includes housing elements integrally combined in forming said housing, said housing elements being substantially symmetrical for nestingly aligning said housing elements when said housing is in unassembled form.

9. An assemblage of postal boxes, comprising:

a body with a generally cylindrical shape;

a plurality of individual storage means within said body;

A plurality of individual hinged door means each said individual hinged door means hingedly closing one of said plurality of individual storage means;

individual locking means on each one of said plurality of individual hinged door means for releasably locking said individual hinged door means;

multiple access means for allowing concurrent access to a first plurality of said individual storage means, said first plurality constituting less than the entirety of said plurality of individual storage means, said multiple access means including a strip means releasably attached to an unhinged side of each said individual door means closing each of said first plurality of individual storage means; and multiple locking means for releasably securing said multiple access means to said body, simultaneously causing such concurrent access to said first plurality of individual storage means upon release of said multiple locking means and motion of said strip means outwardly from said body.

10. The assemblage according to claim 9, wherein a plurality of said multiple access means are spaced circumferentially about the exterior of said body.

11. The assemblage according to claim 10, wherein said multiple locking means includes means for securing said multiple access means to said body near the ends of said body.

12. The apparatus of claim 9, wherein such concurrent access to said first plurality of said individual storage means is enabled by said strip means remaining attached to, and moving with, said individual hinged door means.

13. The apparatus according to claim 12, wherein, upon release of said multiple locking means, said strip means is movable along an arcuate path centered about aligned hinges of said individual hinged door means releasably attached to said strip means.

14. The apparatus according to claim 9, wherein said individual locking means releasably attaches said strip means to an unhinged side of each said individual hinged door means closing each of said first plurality of said individual storage means.

15. The apparatus according to claim 14, wherein said individual locking means releasably attaches to said strip means by friction when said multiple access means is open and allowing concurrent access to said first plurality of said individual storage means.

16. The apparatus according to claim 9, wherein said plurality of individual storage means is formed by conjunction of frame members, each said individual storage means having four walls formed by two said frame members.

17. The apparatus according to claim 16, wherein each said frame member forms inner walls of a plurality of said individual storage means with only one face of said frame member.

* * * * *